United States Patent [19]

Stryjewski et al.

[11] 4,199,626

[45] Apr. 22, 1980

[54] ELECTROGRAPHIC FIXING MEMBER AND APPARATUS AND PROCESS USING SAME

[75] Inventors: Walter A. Stryjewski, Hilton; John F. Wright, Rochester, both of N.Y.

[73] Assignee: Eastman Kodak Company, Rochester, N.Y.

[21] Appl. No.: 612,074

[22] Filed: Sep. 10, 1975

[51] Int. Cl.[2] ..... G03G 15/20

[52] U.S. Cl. ..... 427/444; 29/132; 428/421; 428/422; 428/463; 432/60; 430/124; 355/3 FU; 118/60; 118/653

[58] Field of Search ..... 427/22, 444; 118/60; 219/216; 432/60; 29/130, 132; 428/421, 422, 463

[56] References Cited

U.S. PATENT DOCUMENTS

| | | | |
|---|---|---|---|
| T934,010 | 5/1975 | Maskornick | 29/130 |
| 3,268,351 | 8/1966 | Van Dorn | 427/22 |
| 3,467,638 | 9/1969 | Pattison | 260/87.5 |
| 3,686,154 | 8/1972 | Khan | 260/87.5 A |
| 3,809,854 | 5/1974 | Sanders | 219/216 |
| 3,912,901 | 10/1975 | Strella | 219/216 |

FOREIGN PATENT DOCUMENTS 1145445 3/1969 United Kingdom .

OTHER PUBLICATIONS

*Product Licensing Index*, "Electrographic Fusing Apparatus", Jul., 1972, pp. 72–73.

Rubber Chemistry and Technology, vol. 44, No. 3, pp. 660–667, (Jun., 1971).

Journal of Polymer Science; Part A-1, vol. 8, pp. 1091–1098 (1970).

*Primary Examiner*—Michael F. Esposito

*Assistant Examiner*—Stuart D. Frenkel

*Attorney, Agent, or Firm*—William T. French

[57] ABSTRACT

A fixing member having an abhesive surface for fusing a heat-softenable toner powder image to an appropriate receiving member is disclosed together with a fixing apparatus, e.g., a roller-fuser device, and a fixing process which employs such a fixing member. The surface of the fixing member bears an abhesive elastomeric fluoropolymer composition containing a crosslinked polymer comprising tetrafluoroethylene repeating units and perfluoroalkyl perfluorovinylether repeating units.

14 Claims, 2 Drawing Figures

FIG. 1
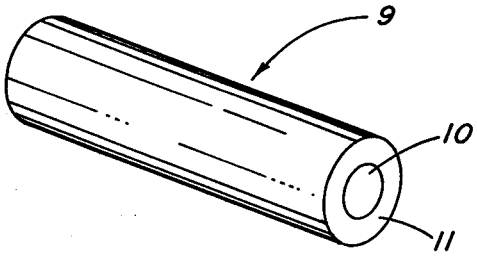
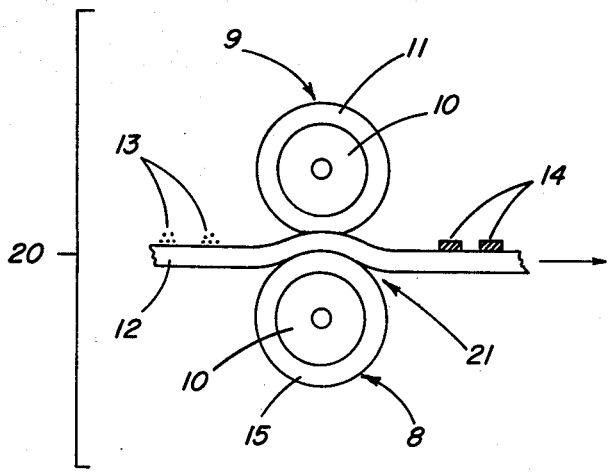
FIG. 2

ELECTROGRAPHIC FIXING MEMBER AND APPARATUS AND PROCESS USING SAME

FIELD OF THE INVENTION

This invention relates to the fixing of a heat-softenable toner powder image, such as is formed in an electrographic copying process, to the surface of a receiving member. More particularly, this invention relates to the use of an improved abhesive-surfaced fixing member and to a process and apparatus which use the same to enhance the fixing of heat-softenable toner particle images.

BACKGROUND OF THE INVENTION

As is well known in the electrographic fixing art, various apparatus adapted to apply heat and pressure have been found useful to permanently fuse images composed of heat-softenable electrographic toner particles to a receiving member, such as a plain paper copy sheet. Such apparatus generally includes at least one fixing member having a surface bearing an adhesive (i.e., non-stick) composition to prevent "offset" of toner particles during the fixing process, i.e., adherence of heat-softened toner particles onto the surface of the fixing member. In one typical embodiment of such fixing apparatus, there is provided at least one pair of rollers which are arranged in a parallel fashion and are adapted to be rotatably driven to advance a heat-softenable toner-bearing paper web therebetween. At least one of the rollers useful in such an apparatus possesses an inner core or cylinder having one or more outer adhesive layers disposed thereon. Means are provided in such an apparatus such that at least one of the rollers which contacts the heat-softenable toner-bearing web is heated to a temperature sufficient to produce tackification of the toner particles. Such heat can be applied to the heated roller by a source of radiant energy, steam and/or a resistance coil located in the roller core, or can be applied by an external directional source of thermal energy.

As noted above, it is known in the electrographic fixing art (in order to prevent offsetting of toner particles onto the surfaces of fixing members, e.g., the roller(s) of the above-described fusing apparatus) that it is desirable to provide one or more of the rollers with a coating of a material known for its "adhesive" qualities, i.e., its release characteristics. It is also desirable that such adhesive materials should exhibit excellent chemical and physical stability when subjected to long periods of exposure to relatively high heat conditions, e.g., temperatures greater than about 120° C., and high pressure conditions, i.e., lineal pressures greater than about 2.5 kg./cm.

Extended research and development activity has been undertaken to discover classes of materials useful as adhesive covering materials in fixing devices such as the above-described "roller-fuser" apparatus. However, to date, the art has relied almost exclusively on a handful of specific polymeric materials including various silicone elastomers, and certain fluorocarbon-containing polymers such as Teflon (a trademark of E. I. duPont de Nemours and Co. for hompolymers of tetrafluoroethylene and various copolymers of tetrafluoroethylene and other fluorinated olefins such as hexafluoropropylene) and certain fluorocarbon-based elastomers such as various vinlidene fluoride-based elastomers which contain hexafluoropropylene as a co-monomer, e.g., Viton® A (vinylidene fluoride-hexafluoropropylene) and Viton® B (vinylidene fluoride-hexafluoropropylene-tetrafluoroethylene), both of which are also available from the duPont Company. Among the various publications in the art which disclose fusing devices employing one or more abhesive materials of the types noted immediately hereinabove are U.S. Pat. No. 3,268,351, issued Aug. 23, 1966; U.S. Pat. No. 3,666,247, issued May 30, 1972; an article entitled "Electrographic Fusing Apparatus" appearing in the July 1972 issue of *Product Licensing Index* at pages 72–73; and in U.S. Pat. No. 3,795,033, issued Mar. 5, 1974.

Various support members having abhesive covering compositions selected from certain of the materials described above have been found useful as fixing members in commercial electrographic fusing devices. However, it has generally been found necessary to also incorporate in or on the surface of such abhesive compositions various so-called "wicking oils" or "release liquids". Such wicking oils generally include various fluorocarbon liquids, silicone liquids, or fluorosilicone liquids and are necessary to increase the release characteristics of the fixing member(s) used in the fusing device. In addition, it has also been found that it is necessary to add various filler materials to many of the abhesive coating materials noted above to increase the thermal stability and/or mechanical strength of the resultant abhesive composition so that it can withstand the high temperatures and pressures which are used in fusing devices.

As a consequence of the foregoing problems associated with many of the known abhesive compositions used in fixing devices such as those described in the aforementioned publications, there is a need to find improved abhesive-surfaced fixing members for use in such devices.

SUMMARY OF THE INVENTION

In accordance with the present invention there is provided an improved fixing member having an abhesive surface for fusing a heat-softenable toner powder image to an appropriate receiving member, such as a paper web. The surface of the fixing member of the invention bears an adhesive composition comprising an elastomeric fluoropolymer, the elastomeric fluoropolymer being a crosslinked polymer comprising tetrafluoroethylene repeating units and perfluoroalkyl perfluorovinylether repeating units.

In accord with one embodiment of the invention the above-described fixing member comprises a roll having a cylindrical core bearing the above-described adhesive composition.

In accord with a further embodiment of the invention, there is provided an improved fuser device for fixing heat-softenable toner powder images to a suitable receiving member. Such fuser devices have at least first and second pressure applicator members mounted therein such that when the peripheral surfaces of said first and second pressure applicator members are brought together in pressure contact there is defined a fixing zone which is adapted to receive and pass therethrough a heat-softenable, toner powder image-bearing receiving member. The fuser device also includes means to apply heat in the fixing zone of the device to soften heat-softenable toner powder images carried on receiving members passing through the fixing zone. At least one of the pressure applicator members of the improved fuser device of the invention bears an adhesive composition as described above.

In accord with the present invention, such fuser devices having the above-described pressure applicator members mounted therein may be used in a process for fixing heat-softenable toner powder images to a receiving member by contacting a surface of the receiving member bearing a heat-softenable toner powder image thereon with the surface of the fixing member for a time and at a temperature sufficient to permit heating and fusion of the heat-softenable toner powder image to the receiving member.

BRIEF DESCRIPTION OF THE DRAWINGS

FIG. 1 shows a particularly useful embodiment of the invention wherein the fixing member is a fixing roll.

FIG. 2 shows a schematic view of a roller-fuser device of the invention having two rotatably mounted fixing rolls adapted to receive a heat-softenable, toner particle image-bearing member in the nip formed by the rolls.

DESCRIPTION OF THE PREFERRED EMBODIMENTS

As set forth above, a primary feature of the present invention resides in the use of a crosslinked polymer having tetrafluoroethylene repeating units and perfluoroalkyl perfluorovinylether repeating units as an elastomeric fluoropolymer in an adhesive composition carried on the surface of a fixing member. Although certain other types of elastomeric fluoropolymers have previously been suggested for use in an adhesive composition of a fixing member, it has been found that fixing members using the particular elastomeric fluoropolymers described herein exhibit a number of highly advantageous and improved properties in comparison to fixing members using previously suggested types of elastomeric fluoropolymer materials.

For example, although it is recognized that many fluoropolymer materials exhibit good release properties, it has generally been found that such polymers, when used in an adhesive composition of a fixing member, nevertheless require substantial amounts of additional "wicking oils" or release liquids to provide sufficient release properties such that offset of toner particles onto the surface of the fixing member is reduced to an acceptable level. In contrast, the particular elastomeric fluorocarbon-surfaced fixing members of the present invention have unexpectedly been found to exhibit such improved release characteristics that the amount of "wicking oil" which is typically employed together with conventional fluorocarbon-surfaced fixing members can be substantially reduced, and, in some cases, it is possible to completely eliminate use of the wicking liquid.

In addition, the adhesive fluorocarbon material used in the present invention is, as noted above, an elastomeric composition so that a fixing member bearing an adhesive composition containing such a material advantageously exhibits compliancy properties when used in a fuser device as described herein. Such compliancy properties are not exhibited by many of the conventional fluoropolymers now used as adhesive coverings for fixing members, e.g., various Teflon®-containing adhesive coverings. Some compliancy properties are, however, exhibited by the various type of Viton® elastomeric fluoropolymer materials which, as set forth in the aforementioned *Product Licensing Index* article, have previously been used in adhesive covering composition of fixing members. However, fixing members bearing the previously described Viton® elastomeric fluorocarbon polymers have not been found to exhibit release properties or heat stability properties comparable to that exhibited by fixing members bearing the elastomeric fluoropolymer materials used in the present invention. Accordingly, fixing members of the present invention have the potential to provide a much longer useful wear life in a fuser device and fixing process and for producing well-fixed images on a suitable receiving member with a minimal amount of undesirable toner offset onto the fixing member (which leads to the undesired deposit of toner particles in background areas of the image-bearing receiving member and also to decreased wear life of the fixing member).

The fluorinated polymeric materials useful in the present invention are crosslinked fluoropolymers having tetrafluoroethylene repeating units and perfluoroalkyl perfluorovinylether repeating units. The perfluoroalkyl perfluorovinylether monomers used in the preparation of the fluorocarbon materials useful in the present invention have the structural formula noted hereinbelow:

$$ROCF{=}CF_2 \qquad \text{I}$$

wherein R is a perfluoroalkyl group containing 1 to about 5 carbons, preferably 1 to about 3 carbon atoms. A particularly useful perfluoroalkyl perfluorovinylether monomer useful in preparing the above-described fluorocarbon elastomers is a perfluoromethyl perfluorovinylether monomer, i.e., a material having the formula I wherein R is a perfluoromethyl group. Copolymers having the above-described tetrafluoroethylene repeating units and perfluoroalkyl perfluorovinylether repeating units have previously been described in the fluorocarbon polymer art and detailed information concerning the preparation of these materials may be found, for example, in U.S. Pat. No. 3,132,123, issued May 5, 1964; Canadian Pat. No. 894,898, issued Mar. 7, 1972; and in the article entitled "A High-Performance Fluorocarbon Elastomer" authored by A. L. Barney et al and appearing in the *Journal of Polymer Science;* Part A-1, Vol. 8 pp. 1091–1098 (1970).

It is believed that those copolymers of the type noted immediately hereinabove which provide best results in accord with the present invention are copolymers having tetrafluoroethylene units and perfluoroalkyl perfluorovinylether units wherein the amount of the ether monomer in the polymer chain is greater than about 30 mole percent and preferably on the order of from about 30 to about 50 mole percent of the polymer chain. Fluorocarbon polymers containing repeating tetrafluoroethylene units and repeating perfluoroalkyl perfluorovinylether units which have less than about 30 mole percent of the ether monomer in the polymer chain can also be used in the present invention, although such monomers are believed to exhibit somewhat lower temperature stability and somewhat less chemical resistance properties.

As noted hereinabove, the copolymers useful in the present invention are crosslinked (i.e., vulcanized) copolymers. Such crosslinked copolymers may be prepared by at least several different techniques.

One such technique for preparing crosslinked copolymers useful in the invention is described in U.S. Pat. No. 3,686,154, issued Aug. 22, 1972 and relates to the use of a curing agent selected from the group consisting of polyfunctional tertiary amines and precursors thereof capable of forming such amines in situ. Such curing agents can be admixed with the aforementioned copolymer having repeating tetrafluoroethylene units and repeating perfluoroalkyl perfluorovinylether units; and, in the presence of heating, one obtains the desired crosslinked fluorocarbon elastomer as the endothermic reaction product of the above-described copolymer and crosslinking agent. The amount of crosslinking agent used in the preparation of the aforementioned endothermic reaction product typically is within the range of from about 2 to about 5 percent of crosslinking agent based on the weight of the aforementioned copolymer.

Typical useful such crosslinking agents, as noted above, are polyfunctional tertiary amines or precursors thereof capable of forming such amines in situ. A partial list of useful such materials is set forth in U.S. Pat. No. 3,686,154 and includes salts of triethylenediamine (e.g., the sulfates, chlorides and borates) which are capable of forming the tertiary amines in situ during heating; tris(-dodecylmethylene)diamine; 3-(1,5-diazobicyclo)(3,2,1)-oct-8-yl indole; 4,4'-methylene-bis(N,N'-dimethyl aniline); 2,3-bis-(2-pyridyl)-5,6-dihydropyrazine; 4,4'-trimethylene dipyridine; 4,4'-trimethylene-bis-(N-piperidine ethanol); N,N'-bis-(R)piperazines wherein R is a $C_1$–$C_6$ alkyl group of a substituted analog thereof (e.g., containing an amino, halide, or hydroxy substituent); and Troegers base, which is also known as 2,8-dimethyl 6H,12H-5,11-methanodibenzo [b,f] [1,5] diazocine. Especially preferred as useful polyfunctional tertiary amine compounds are triethylenediamine and N,N'-bis-(3-aminopropyl)piperazine.

Another useful method for preparing the crosslinked fluorocarbon copolymers useful in the present invention is to blend a third fluorinated monomer together with the tetrafluoroethylene and perfluoroalkyl perfluorovinylether monomers used in making the initial copolymer such that one obtains a terpolymer of tetrafluoroethylene, perfluoroalkyl perfluorovinylether and the third fluorinated monomer. The latter component, i.e., the fluorinated monomer, is a monomer containing fluoroalkyl or fluoroalkylene groups and a crosslinking site such that the resultant terpolymer containing the same may be readily crosslinked in the presence of suitable curing agents such as hydrazine or aliphatic diamines containing 2 to 20 carbon atoms, e.g., p-phenylene diamine, tetraethylene pentamine, hexamethylene diamine carbonate, etc. In this embodiment of the invention, the third component fluorinated monomers containing a crosslinking site may be selected from various such monomers. For example, this monomer may be selected from a class of monomers containing a perfluoroalkyl or perfluoroalkylene group and a crosslinking site, such as monomers having one of the following structural formulas:

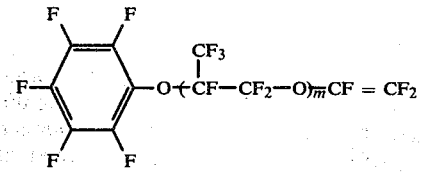

II.

wherein m represents the integer of 1 or 2.

$$CF_2{=}CF{-}O{-}(CF_2)_n{-}X \qquad \text{III}$$

wherein n is an integer of from about 2 to about 12, preferably 2–4, —X is a member selected from the group consisting of —COF, —COOH, —$COOR_1$, —COOM, —$CONR_2R_3$ and —CN, $R_1$ being an alkyl radical containing 1 to 10 carbon atoms, $R_2$ and $R_3$ each being hydrogen or $R_1$, and M being sodium, potassium or cesium.

Terpolymers containing the above-described tetrafluoroethylene units, perfluoroalkyl perfluorovinylether units, and fluorinated monomers bearing a crosslinking site are known in the art and have been described, for example, in U.S. Pat. No. 3,467,638 dated Sept. 16, 1969, British Pat. No. 1,145,445, dated Mar. 12, 1969 and in the article entitled "Vulcanizate Properties from a New Perfluoroelastomer" by A. L. Barney et. al. in *Rubber Chemistry and Technology,* Vol. 44, No. 3, June 1971, pp. 660–667. In general, these terpolymers, prior to crosslinking with a curing agent(s), contain only a minor amount of the fluorinated monomer bearing a crosslinking site; for example, a typical terpolymer contains from about 0.1 to about 5 percent by weight of repeating units derived from the monomer bearing a crosslinking site. Further details regarding the crosslinked copolymer, including crosslinked terpolymers, useful in the present invention may be found in the aforementioned patent publications and journal articles incorporated herein by reference thereto.

In the fixing device and process of the present invention, the fixing member to which above-described crosslinked polymeric fluorocarbon material is attached may have a variety of different shapes. For example, the fixing member may be a flat plate bearing the aforementioned adhesive composition. Generally, however, the fixing member has an arcuate surface (i.e., a curved surface) so that the adhesive surface composition on the fixing member which contacts the receiving member bearing the heat-softenable toner powder image makes an appropriate contact angle therewith thereby enhancing contact and release of the receiving member from the adhesive-surfaced fixing member. In one particularly advantageous embodiment of the invention, as noted in FIG. 1 attached hereto, the fixing member is a roll 9 composed of a cylindrical core 10 bearing a covering or blanket 11 of the adhesive composition containing the above-described crosslinked polymeric fluorocarbon material. The thickness of the adhesive covering 11 on cylinder 10 can vary from relatively thin adhesive layers having a thickness on the order of about 0.002 cm. to much thicker layers, e.g., layers having a thickness up to about 0.30 cm. Thinner or thicker adhesive layers may also be useful. In large part, the thickness or thinness of the adhesive composition on a fixing member of the invention will depend upon the particular properties, e.g., compliancy or hardness, thermal conductivity, etc., which may be desired in a specific application. Typically, good results have been obtained in accord with the invention using fixing members having an adhesive composition containing the above-described crosslinked polymeric fluorocarbon elastomer with a thickness within the range of from about 0.04 cm. to about 0.20 cm.

The core of the fixing member may be composed of any of various materials depending on the properties, particularly the thermal properties, which are desired. For example, in the case of a roller-fuser device wherein the heating means of the fuser device is an external heat source, one may use as the core of the fixing member a material which is heat conductive or insulative. On the other hand, in the situation where the core of the fixing member contains therein a heat source which provides the thermal energy used in the fuser device of the present invention, it is typically desirable to use as the core a material, such as a metal, e.g., aluminum, capable of transmitting the thermal energy to the periphery of the fixing member. Of course, where the internal heat source is a radiant heat source, such as an infrared heater, it may be desirable to use an infrared transmitting material for the core of the fixing member, e.g., quartz.

To further enhance the various properties of the fixing member of the present invention, it may be useful, in certain situations, to provide various fillers to further enhance thermal properties, mechanical strength, or release properties of the adhesive coating composition employed in the fixing member. Typically, various fillers which may be used include those fillers useful with various other fluorocarbon polymeric materials such as various pigments, for example, carbon black, other fillers such as silica, etc., as well as various metal oxides, metal particles, or low surface energy particles composed of other fluoropolymer materials, and the like. In addition, various pore-forming agents, plasticizers, etc, may also be used in the adhesive compositions of the fixing members of the present invention where necessary or desirable.

As indicated hereinabove, the fixing member of the present invention can be used with little or no wicking oil or "offset preventing fluid", as it is sometimes called. In certain situations, however, it may be desirable to provide the surface of the adhesive polymeric fluorocarbon composition described hereinabove with a suitable wicking oil which can also serve to maintain the fixing member free from contamination by fibers, fillers, etc., emanating from the toner-bearing receiving member, e.g., a paper web. Such wicking oils can be applied to the surface of the adhesive composition by, for example, a wick which extends across the length of the roller and is continuously soaked with the liquid, or by a liquid-bearing applicator roller which contacts the fusing member surface. A large number of known release liquids are commercially available and suitable for use as wicking oils. For example, a series of silicone glycol copolymer liquids as well as alkylaryl silicone liquid, a chlorophenylmethyl silicone liquid, a dimethylsilicone liquid and a fluorosilicone liquid are commercially available from Dow Corning Company. Additional useful materials would include polyvinylidene fluoride liquids, polymonochlorotrifluoroethylene liquids, hexafluoropropylene-vinylidene fluoride copolymers, perfluoroalkyl polyethers (available under such names as Fomblyn and Krytox, sold by Montecatini-Edison and duPont, respectively), fluoroalkyl esters, block copolymers of dimethyl siloxane with a variety of materials such as Bisphenol A, tetramethylspirobi(inda)diol, and the like. Of course, other useful release liquids exhibiting good thermal stability may also be used in addition to those noted immediately hereinabove. Obviously, in selecting a particular release liquid, care should be taken to select a liquid which is chemically compatible with the fluorocarbon-containing adhesive composition of the fixing member of the present invention.

As noted hereinabove, the fixing member of the present invention is typically used in a heat and pressure fixing device having at least two pressure applicator members, typically two parallel rolls rotatably mounted in the device, adapted to receive a heat-softenable toner image-bearing receiving member between the peripheral surfaces of the pressure applicator members, e.g., in the nip between two rotatably mounted fusing rolls. At least one of the pressure applicator members of such a device is a fixing member of the type described herein bearing an adhesive composition containing the above-described crosslinked elastomeric fluorocarbon. The remaining pressure applicator member or members of the device may or may not have an adhesive coating composition depending upon the particular device, the desired number of copies to be driven through the device, and the like.

In one especially useful embodiment of the present invention, as shown in FIG. 2, the heat fixing device of the invention is a roller-fuser device 20 having a pair of rotatably mounted pressure applicator rolls 8 and 9 whose peripheral surfaces are in pressure contact with one another such that nip 21 between the rolls is capable of advancing a toner image-bearing receiving member, for example, a paper web 12 bearing a heat-softenable toner powder image 13 therebetween. In such a device, one of the rolls 9 has an adhesive composition 11 (as described hereinabove containing a crosslinked elastomeric fluoropolymer having repeating tetrafluoroethylene units and repeating perfluoroalkyl perfluorovinylether units) covering cylinder 10. The lineal pressure between rolls 8 and 9 which is applied at nip 21 to the paper receiving web may vary, but typically is within the range of from about 0.05 to about 4.0 kg/cm. The temperature maintained in the nip which serves as the heat-fixing zone of the roller-fuser device is generally within the range of from about 110° C. to about 260° C., the particular temperature depending upon the softening temperature of the particular toner powder being used and the rate at which the receiving web bearing the toner powder image is driven through the nip and fused to form permanent image 14. In a device of the type shown in FIG. 2, roll 9 may be uncoated or, as shown in FIG. 2, may also bear an adhesive composition, such as layer 15. In addition, if desirable, roll 9 in FIG. 2 can be a duplicate of roll 8 described above.

EXAMPLE

To illustrate the enhanced release characteristics exhibited by the fixing members of the present invention a series of three fixing members were manufactured and the release characteristics of the members were compared. Each member consisted of a hollow cylindrical aluminum core having a length of about 30 cm. and an outside diameter of about 8.3 cm. Each cylindrical core had an adhesive composition bonded to its surface. Fixing member 1 (a control) had an adhesive composition composed of a layer about 0.30 cm. thick of an elastomeric fluoropolymer of vinylidene fluoride and hexafluoropropylene (i.e., Viton® A made by duPont). Fixing member 2 (a control) had an adhesive composition composed of a layer about 0.30 cm. thick of an elastomeric fluoropolymer of vinylidene fluoride, hexafluoropropylene, and tetrafluoroethylene (i.e., Viton® B, made by duPont). Fixing member 3 (of the invention) had an adhesive composition composed of a layer about 0.038 cm. thick of an elastomeric fluoropolymer of a crosslinked terpolymer of tetrafluoroethylene, perfluoromethyl perfluorovinylether, and a fluorinated monomer having formula II noted above and prepared in a manner similar to that described in Examples 5 and 6 of U.S. Pat. No. 3,467,638. The release characteristics of each of Members 1–3 were evaluated using a paper copy sheet bearing an unfused test image of thermoplastic electrographic toner particles composed of a styrene copolymer, colorant, and charge agent. The release characteristics of members 1–3 were evaluated using a test roller-fuser device of the type shown in FIG. 2. In the test roller-fuser device, members 1–3 were used as roll 9. Roll 8 of the test device consisted of a pressure roll having an aluminum core similar in size to that of members 1–3 described above and as layer 15 a coating composition consisting of a Teflon® fluoropolymer made by duPont. Rolls 8 and 9 of the test device were mechanically driven at a speed of 25.4 cm./sec. and the lineal pressure exerted in the nip between rolls 8 and 9 was set at about 2.7 kg./cm. The temperature of the surface of roll 9 was maintained at about 190° C. during the tests of each of members 1–3 in the test roller-fuser device. An identical set of plain paper copy sheets, each bearing a test stripe of the above-described unfused, thermoplastic toner particles were fed through the fixing zone, i.e., nip 21, of the device shown in FIG. 2. Wicking oil was applied to the surface of roll 9 for the test of members 1 and 2. No wicking oil was applied to either roll 8 or roll 9 for the test of member 3. Following the tests, each of members 1–3 were ranked in terms of their release characteristics to the control toner particles. As a result, it was found that member 3 of the present invention exhibited release properties superior or equivalent to those exibited by members 1 and 2 even though no wicking oil was used with member 3. There was no visible "offset" of toner particles from the test image onto member 3, whereas substantial toner particle "offset" was visible on fixing member 1 and some "offset" also occurred with member 2.

The invention has been described in detail with particular reference to certain preferred embodiments thereof, but it will be understood that variations and modifications can be effected within the spirit and scope of the invention.

We claim:

1. A roll useful as a fixing member in a direct fuser device for fixing heat-softenable toner powder images to a receiving member by contacting the heat-softenable toner powder image with said roll, said roll comprising a cylindrical core having an adhesive composition comprising an elastomeric fluoropolymer affixed to the peripheral surface of said core, said elastomeric fluoropolymer being a crosslinked polymer comprising repeating units of tetrafluoroethylene and perfluoroalkyl perfluorovinylether.

2. A roll useful as a fixing member as defined in claim 1 wherein said core is a metal cylinder and wherein said crosslinked polymer is the endothermic reaction product of a copolymer having repeating tetrafluoroethylene units and repeating perfluoroalkyl perfluorovinylether units and a compound selected from the group consisting of polyfunctional tertiary amines and precursors thereof capable of forming such amines in situ.

3. A roll useful as a fixing member as defined in claim 1 wherein said core is a metal cylinder and wherein said crosslinked polymer is the endothermic reaction product of a copolymer having repeating tetrafluoroethylene units and repeating perfluoroalkyl perfluorovinylether units and a compound selected from the group consisting of triethylenediamine and N,N'-bis-(3-aminopropyl)piperazine.

4. A roll useful as a fixing member as defined in claim 1 wherein said core is a metal cylinder and wherein said crosslinked polymer is a crosslinked copolymer of tetrafluoroethylene,perfluoroalkyl perfluorovinylether, and a monomer comprising a fluorinated alkyl or fluorinated alkylene group and a crosslinking site.

5. A roll useful as a fixing member as defined in claim 1 wherein said core is a metal cylinder and wherein said crosslinked polymer is a crosslinked copolymer having repeating units of tetrafluoroethylene, perfluoroalkyl perfluorovinylether, and a fluorinated monomer bearing a crosslinking site, said monomer having the formula $CF_2{=}CF{-}O{-}(CF_2)_n{-}X$ wherein n is an integer of from about 2 to about 12 and —X is a member selected from the group consisting of —COF, —COOH, $-COOR_1$, —COOM, $-CONR_2R_3$ and —CN, $R_1$ being an alkyl radical containing 1 to 10 carbon atoms, $R_2$ and $R_3$ each being hydrogen or $R_1$, and M being sodium, potassium, or cesium.

6. A roll useful as a fixing member as defined in claim 1 wherein said core is a metal cylinder and wherein said crosslinked polymer is a crosslinked copolymer having repeating units of tetrafluoroethylene, perfluoroalkyl perfluorovinylether, and a fluorinated monomer bearing a crosslinking site, said monomer having the formula

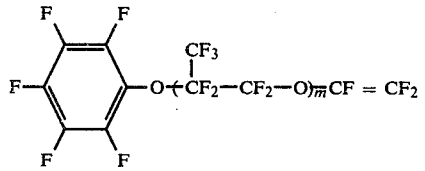

wherein m is the integer 1 or 2.

7. In a roller fuser device for fixing heat-softenable toner powder images to a receiving member, such device having at least first and second pressure applicator rolls mounted therein to define a fixing zone, adapted to pass a heat softenable, toner powder image-bearing receiving member therethrough, when the surfaces of said first and second pressure applicator rolls are brought together, under pressure, in rolling peripheral contact, and means to apply heat in said fixing zone to soften a heat-softenable toner powder image carried on a receiving member passing through said zone, the peripheral surface of at least the pressure applicator roll that contacts the heat-softenable toner powder image bearing an adhesive composition comprising an elastomeric fluoropolymer, the improvement wherein said fluoropolymer comprises a crosslinked polymer comprising repeating tetrafluoroethylene units and repeating perfluoroalkyl perfluorovinylether units.

8. A roller fuser device as defined in claim 7 wherein said crosslinked polymer is the endothermic reaction product of a copolymer having repeating tetrafluoroethylene units and repeating perfluoroalkyl perfluorovinylether units and a compound selected from the group consisting of polyfunctional tertiary amines and precursors thereof capable of forming such amines in situ.

9. A roller fuser device as defined in claim 7 wherein said crosslinked polymer is the endothermic reaction product of a copolymer having repeating tetrafluoroethylene units and repeating perfluoroalkyl perfluorovinylether units and a compound selected from the group consisting of triethylenediamine and N,N'-bis-(3-aminopropyl) piperazine.

10. A roller fuser device as defined in claim 7 wherein said crosslinked polymer is a crosslinked copolymer of tetrafluoroethylene, perfluoroalkyl perfluorovinylether, and a monomer comprising a fluorinated alkyl or fluorinated alkylene group and a crosslinking site.

11. A roller fuser device as defined in claim 7 wherein said crosslinked polymer is a crosslinked copolymer of tetrafluoroethylene, perfluoroalkyl perfluorovinylether, and a monomer comprising a fluorinated alkyl or fluorinated alkylene group and a crosslinking site, said monomer having the formula

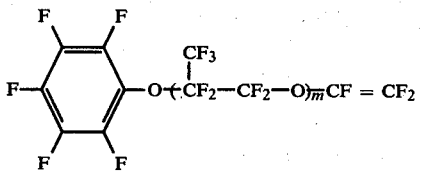

wherein m is the integer 1 or 2.

12. A member useful in a fuser device, said member comprising a core having an arcuate surface and having a composition comprising an elastomer affixed to the surface of said core, said elastomer being a crosslinked polymer comprising repeating units of tetrafluoroethylene and perfluoroalkyl perfluorovinyl ether.

13. A member according to claim 12 wherein said core is an aluminum core and said elastomer contains a filler dispersed therein.

14. In a method of fixing a heat-softenable toner powder image to a receiving member which comprises pressure contacting a heat-softenable toner powder image carried on a receiving member with a fixing member bearing an adhesive composition comprising an elastomer fluoropolymer at a temperature effective to fuse said toner powder image to said receiving member, the improvement which comprises using as said elastomeric fluoropolymer a crosslinked polymer comprising repeating tetrafluoroethylene units and repeating perfluoroalkyl perfluorovinylether units.

* * * * *